US005171464A

United States Patent [19]

de Montigny et al.

[11] Patent Number: 5,171,464

[45] Date of Patent: Dec. 15, 1992

[54] LUBRICANT BASED ON POLYORGANOSILOXANES

[75] Inventors: Armand de Montigny, Leverkusen; Wilfried Kortmann, Nachrodt-Wiblingwerde, both of Fed. Rep. of Germany

[73] Assignee: Bayer Aktiengesellschaft, Leverkusen, Fed. Rep. of Germany

[21] Appl. No.: 390,578

[22] Filed: Aug. 7, 1989

[30] Foreign Application Priority Data

Aug. 31, 1988 [DE] Fed. Rep. of Germany ..... 3829467

[51] Int. Cl.[5] ..... C10M 107/50

[52] U.S. Cl. ..... 252/49.6; 252/8.6; 252/8.9

[58] Field of Search ..... 252/99.6, 8.9

[56] References Cited

U.S. PATENT DOCUMENTS

| | | | |
|---|---|---|---|
| 2,588,365 | 11/1949 | Dennett | 117/161 |
| 3,192,161 | 6/1965 | Wisotsky | 252/49.6 |
| 3,418,160 | 12/1968 | Abashian | 117/138.8 |
| 3,896,032 | 7/1975 | Stroh et al. | 252/8.6 |
| 4,076,672 | 2/1978 | Huber et al. | 252/8.6 |
| 4,434,008 | 2/1984 | Dumm et al. | 106/271 |
| 4,456,542 | 6/1984 | Wagner et al. | 252/8.6 |
| 4,561,987 | 12/1985 | Yamamoto et al. | 252/8.9 |

FOREIGN PATENT DOCUMENTS

| | | |
|---|---|---|
| 0259625 | 3/1988 | European Pat. Off. . |
| 2298349 | 4/1975 | France . |
| 1155742 | 6/1969 | United Kingdom . |

*Primary Examiner*—Ellen McAvoy

*Attorney, Agent, or Firm*—Sprung Horn Kramer & Woods

[57] ABSTRACT

A lubricant for a substrate, particularly a synthetic material, comprising a hydrogen polyorganosiloxane having the structure

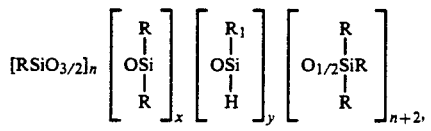

in which R is an alkyl radical containing up to 14 C atoms or a halogen- or pseudohalogen-substituted low molecular weight alkyl radical or a phenyl radical, with the proviso that at least 50% of all the R radicals consist of methyl groups; $R_1$ is a methyl radical; n is a number from 0 to 15; x is a number from 100 to 1000 and y is a number from 2 to 10. The lubricant is particularly useful in a method to lubricate artificial turf such as the type used on football, soccer and baseball fields.

17 Claims, No Drawings

LUBRICANT BASED ON POLYORGANOSILOXANES

BACKGROUND OF THE INVENTION

1. Field of the Invention

This invention relates to a lubricant based on special hydrogen polyorganosiloxanes which provides synthetic materials with high surface slip which is retained for prolonged periods, even under severe stressing.

2. Background Information

Lubricants based on diorganopolysiloxanes, optionally in admixture with organic substances, such as waxes, for example, have been known and used for some time. Thus, according to U.S. Pat. No. 3,896,032, mixtures of diorganopolysiloxanes of different viscosity, which contain terminal $R_2Si(OR')O_{\frac{1}{2}}$ groups (where R' may be a hydrogen atom or an alkyl radical), optionally in addition to terminal $R_3SiO_{\frac{1}{2}}$ groups, are effective lubricants. According to U.S. Pat. No. 4,076,672, diorganopolysiloxanes obtained by emulsion polymerization, which have a viscosity of at least 20,000 cST at 25° C., are used in admixture with waxes or organic, optionally substituted polymers. U.S. Pat. No. 4,434,008 describes oil-in-water dispersions of which the active component consists of 5 to 80% by weight silicon oil having a viscosity of 500 to 50,000 mP.s at 25° C. and, for the rest, of wax, fatty acids, cationic imidazolinium salts and ethoxylated fatty amines. According to U.S. Pat. No. 4,561,987, polyether polysiloxanes are also said to show good lubricating properties.

Practical tests have shown that the lubricants described in the above-mentioned patent specifications, although capable of providing certain yarns, fibers, films etc. with the required properties, are unsatisfactory in their lubricating effect on certain substrates.

For example, artificial turf consisting of polypropylene fibers requires extremely high smoothness comparable with that of natural turf, a property which can only be imparted to artificial turf by treatment with a smoothing agent. In the absence of these properties, injuries and burns can be sustained by anybody falling and sliding on artificial turf. If artificial turf of the type in question is used in sport, particular importance is attributed to its smoothness in the case of sports requiring high skills. If, for example, artificial turf of the type in question is intended for a sports field, it must combine the surface slip discussed above with other properties specific to the particular sport. For example, where artificial turf is used for football pitches, it should not adversely affect the bounce or rolling behavior of footballs. Similar requirements exist in other sports. For example, the properties of artificial ski slopes or of artificial curling rinks should not differ significantly from those of their natural and well prepared counterparts. In addition, the required properties should remain immune for prolonged periods to severe stressing by the user and—in the case of open-air facilities—to atmospheric influences.

SUMMARY OF THE INVENTION

The object of the present invention is to impart the properties described above to substrates, for example, based on polyolefins, polyesters, polyamides and combinations thereof, particularly based on polyolefins. Surprisingly, the properties may be obtained by treating a substrate of the type in question with a hydrogen-containing polysiloxane either from organic solution or from aqueous phase. The lubricant according to the invention, which consists of a hydrogen polyorganosiloxane, is characterized in that it has the following composition:

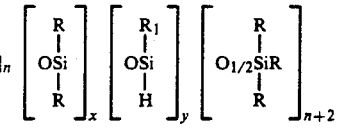

in which R is an alkyl radical containing up to 14 C atoms or a halogen- or pseudohalogen-substituted low molecular weight alkyl radical or a phenyl radical, with the proviso that a least 50% of all the R radicals consist of methyl groups; $R_1$ is a methyl radical, n is a number of 0 to 15, preferably $0<n<2$, x is a number of 100 to 1000, preferably $250<x<600$, and y is a number of 2 to 10, preferably $2.4<y<5$.

DETAILED DESCRIPTION OF THE INVENTION

Products containing $CH_3SiO_{3/2}$—, $(CH_3)_3SiO_{\frac{1}{2}}$—, $(CH_3)_2SiO$— and $CH_3(H)SiO$— units are known in principle and are used in textile chemistry, above all where $x=\geqq 3$, as crosslinking agents together with polyorganosiloxane diols or polyorganosiloxanes containing vinyl groups and the corresponding catalysts (see for example U.S. Pat. No. 2,588,365, U.S. Pat. No. 4,456,542) as hydrophobicizing agents. These products impart only weak, if any, surface slip properties.

Surprisingly, however, the structures according to the invention show excellent surface slip values which, as measured in the Leroux sling test both in the wet state and in the dry state, approach the values of natural turf which, depending on its condition, has values of from 0.05 (ideal grass surface) to 0.3.

It is also surprising that, after application, both adhesion and cohesion are excellent both at ambient temperatures and at temperatures below the softening temperatures of the substrates with or without catalyst, so that the slip values satisfy all the demands made of them, even after weathering tests. Particularly suitable condensation catalysts are tin, zinc or noble metal complexes.

Accordingly, the incorporation of coupling groups, which are often difficult to obtain, is no longer necessary, so that there is no need for example to incorporate aminoalkyl siloxy or epoxysiloxy units.

In addition, the lubricants according to the invention also show very good hydrophobicizing properties and provide textile fabrics with a pleasant feel.

The siloxanes according to the invention may be applied by spraying, dip coating, etc. or as a foam, for example, from organic solutions (cyclohexane), or in the form of aqueous emulsions, being applied in quantities of from 0.1 to 100 g, particularly 0.5 to 50, active substance per square meter, depending on the condition of the substrate surface.

The following examples are intended to illustrate the invention without limiting it in any way.

PRODUCTION EXAMPLES

Example A

A polysiloxane having the following composition

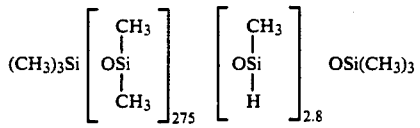

which had been prepared by the method normally used in silicone chemistry, was dissolved in hexane to form a 30% solution.

Example B

A polysiloxane having the following composition

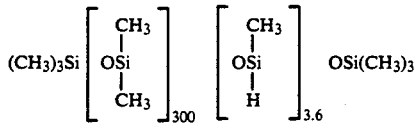

is emulsified in the usual way so that a 40% emulsion free from organic solvent is formed.

APPLICATION EXAMPLES

Example 1

The solution of Example A is sprayed onto a substrate consisting of a polypropylene tape pile tufted (pile weight approx. 1200 g/m$^2$) in such a way that a wet weight of approximately 90 g per square meter is obtained. The wet substrate is freed from organic solvent at a maximum temperature of 110° C. in a dryer of the type commonly used in the textile industry.

After conditioning for 48 hours, surface smoothness is determined by the Leroux sling test. A value of 0.30 is obtained.

Example 2

The emulsion of Example B diluted to 15% with water is sprayed onto a substrate similar to that described in Example 1 in such a way that an active substance content of approximately 25 g/m$^2$ is obtained. The wet substrate is freed from excess water and conditioned in the same way as described in Example 1. The dried substrate is then subjected to the Leroux sling test. A value of 0.30 is obtained. After weathering for 30 days, the Leroux value rises to 0.31.

Example 3

A polyamide-6.6 fiber (monofil) is provided with the finish according to the invention by means of a godet applicator. The take-off rate of the filament is regulated in such a way that 0.4% solids, based on the weight of the fiber, remain on the fiber. The finished fiber is dried in a standard atmosphere (23° C./50% relative humidity) and stored for 7 days. The static friction (=static filament-to-filament friction) is then measured using the adhesion meter (A-meter) described in the following.

Principle of the measuring technique (adhesion meter):

The frictional force $F_R$ opposing the movement of a body is proportional to the normal force $F_N$ and is substantially unaffected by its contact area.

Coulomb's relation:

$$F_R = \mu \cdot F_N (\mu = \textit{coefficient of friction}).$$

If a body lies on a sloping plane, the A value or $\mu$ may be statically determined from the angle $\alpha$ at which the body just begins to slide, i.e., at which the downward force $F_A$ of the slope just overcomes the static friction force $F_R$:

$$\mu_{stat.} = \frac{F_R}{F_N} = \frac{m \cdot g \cdot \sin\alpha}{m \cdot g \cdot \cos\alpha} = \tan\alpha.$$

Structure of the A-meter

On the principle of the sloping plane, a "measuring capsule" was mounted on a rotatable axis which is rotated at a certain speed by a motor so that the capsule can be inclined.

Plates displaceable on two guide rods are mounted in the "capsule", being formed with slots into which the filament is introduced and fixed under a tension of 2×10 p. The slide, over which a filament is also stretched (under a pressure of 10 p), is placed on these filaments fixed parallel to one another and the "metal flag" is pushed into the movable photocell present. If, then, the slide slides out of the photocell at a certain angle, the motor is automatically stopped and the tangent of the slide angle can be read off from the digital indicator. The averaged end value is obtained from 10 individual measurements. The result of the measurements for the finish according to the invention is as follows:

$$\mu = 0.39.$$

What is claimed is:

1. A lubricant for a substrate comprising a polyorganosiloxane having the structure

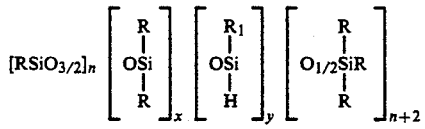

, in which R is an alkyl radical containing up to 14 C atoms or a halogen- or pseudohalogen-substituted low molecular weight alkyl radical or a phenyl radical, with the proviso that at least 50% of all the R radical are methyl groups; $R_1$ is a methyl radical; n is a number from 0 to 15; x is a number from 100 to 1000 and y is a number from 2 to 10.

2. A lubricant as claimed in claim 1, wherein $0 \leqq n < 2$.

3. A lubricant as claimed in claim 1 wherein $250 < x < 600$.

4. A lubricant as claimed in claim 1, wherein $2.4 < y < 5$.

5. A lubricant according to claim 1, which further comprises a condensation catalyst selected from the group consisting of tin, zinc and noble metal complexes.

6. A method of lubricating a substrate comprising applying a lubricant to said substrate, said lubricant comprising a polyorganosiloxane having the structure $$[RSiO_{3/2}]_n \left[ \begin{array}{c} R \\ | \\ OSi \\ | \\ R \end{array} \right]_x \left[ \begin{array}{c} R_1 \\ | \\ OSi \\ | \\ H \end{array} \right]_y \left[ \begin{array}{c} R \\ | \\ O_{1/2}SiR \\ | \\ R \end{array} \right]_{n+2}$$

, in which R is an alkyl radical containing up to 14 C atoms or a halogen- or pseudohalogen-substituted low molecular weight alkyl radical or a phenyl radical, with the proviso that at least 50% of all the R radicals contain methyl groups; $R_1$ is a methyl radical; n is a number from 0 to 15; x is a number from 100 to 1000 and y is a number from 2 to 10.

7. A method as claimed in claim 6, wherein $0 \leqq n < 2$.

8. A method as claimed in claim 6, wherein $250 < x < 600$.

9. A method as claimed in claim 6, wherein $2.4 < y < 5$.

10. A method as claimed in claim 6, wherein the substrate is a synthetic material selected from the group consisting of polyolefins, polyesters, polyamides and combinations thereof.

11. A method as claimed in claim 10, wherein the synthetic material comprises a polyolefin.

12. A method according to claim 6, wherein the substrate is polypropylene.

13. A method as claimed in claim 6, wherein the hydrogen polyorganosiloxane is applied in an amount of 0.1 to 100 g per square meter of substrate.

14. A method as claimed in claim 6, wherein the hydrogen polyorganosiloxane is applied in an amount of 0.5 to 50 g per square meter of substrate.

15. A method as claimed in claim 6, wherein the lubricant further comprises a condensation catalyst selected from the group consisting of tin, zinc and noble metal complexes.

16. A lubricant according to claim 1, wherein the polyorganosiloxane is of the formula $$(CH_3)_3Si \left[ \begin{array}{c} CH_3 \\ | \\ OSi \\ | \\ CH_3 \end{array} \right]_{275} \left[ \begin{array}{c} CH_3 \\ | \\ OSi \\ | \\ H \end{array} \right]_{2.8} OSi(CH_3)_3.$$

17. A lubricant according to claim 1, wherein the polyorganosiloxane is of the formula $$(CH_3)_3Si \left[ \begin{array}{c} CH_3 \\ | \\ OSi \\ | \\ CH_3 \end{array} \right]_{300} \left[ \begin{array}{c} CH_3 \\ | \\ OSi \\ | \\ H \end{array} \right]_{3.6} OSi(CH_3)_3.$$

* * * * *